US006226467B1

(12) United States Patent
Nakagawa et al.

(10) Patent No.: US 6,226,467 B1
(45) Date of Patent: May 1, 2001

(54) DEVELOPER UNIT DETACHABLY ATTACHABLE TO IMAGE FORMING APPARATUS

(75) Inventors: Tsuyoshi Nakagawa, Tokyo; Norihisa Hoshika, Mishima; Tetsuya Kobayashi; Yoshiro Saito, both of Numazu; Kazunori Hashimoto, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/394,415

(22) Filed: Sep. 13, 1999

(30) Foreign Application Priority Data

Sep. 18, 1998 (JP) ..... 10-282075
Aug. 27, 1999 (JP) ..... 11-241667

(51) Int. Cl.[7] ..... G03G 15/00; G03G 15/08

(52) U.S. Cl. ..... 399/55; 399/12; 399/127; 399/254

(58) Field of Search ..... 399/12, 24, 25, 399/27, 43, 49, 53, 127, 254

(56) References Cited

U.S. PATENT DOCUMENTS

| | | | | |
|---|---|---|---|---|
| 4,739,367 | * | 4/1988 | Watanabe et al. | 399/127 X |
| 5,057,867 | * | 10/1991 | Ishigaki et al. | 399/43 |
| 5,250,994 | | 10/1993 | Ito et al. | 355/271 |
| 5,272,503 | * | 12/1993 | LeSueur et al. | 399/25 |
| 5,523,832 | * | 6/1996 | Hamamichi et al. | 399/254 |
| 5,708,915 | * | 1/1998 | Noguchi et al. | 399/49 |
| 5,740,502 | | 4/1998 | Kobayashi et al. | 399/128 |

FOREIGN PATENT DOCUMENTS 62-119565 * 5/1987 (JP) .

* cited by examiner

*Primary Examiner*—Joan Pendegrass
(74) *Attorney, Agent, or Firm*—Fitzpatrick, Cella, Harper & Scinto

(57) ABSTRACT

A unit detachably attachable to a main body of an image forming apparatus includes developing means for developing a latent image born on an image bearing body and storage means for storing a time which has elapsed from a last developing operation of the developing means.

17 Claims, 5 Drawing Sheets

DEVELOPER UNIT DETACHABLY ATTACHABLE TO IMAGE FORMING APPARATUS

BACKGROUND OF THE INVENTION

1. Field of the Invention

The present invention relates to an image forming apparatus, such as an electrophotographic system copying machine, a facsimile, or a printer, and to a unit detachably attachable to a main body of an image forming apparatus.

2. Related Background Art

In an image forming apparatus adopting an electrophotographic system, generally there is known such an image forming apparatus that, for the purpose of preventing an image density from largely varying according to various conditions, such as a change of environment of the image forming apparatus or the number of prints, a developer image for density detection (hereinafter referred to as "patch") is formed on a photosensitive drum as a latent image bearing body whenever image formation for a predetermined number of paper sheets is carried out, the developer density of the patch is detected by an optical sensor, etc., and the detected developer density is fed back to control image formation conditions, such as a developing bias of a development processing condition, so that an image density control is carried out to keep the image density at a predetermined density.

In the foregoing image density control, when the image density control is started, an image density control circuit provided as adjusting means in the image forming apparatus causes a pattern generating circuit to generate an image signal expressing a patch for density detection, and based on this signal, latent images for n patches P1 to Pn are formed along the rotation direction on the photosensitive drum. Next, the latent images are developed by a developing device as developing means. At this time, a high voltage control circuit changes a developing bias (VDC) for each of the patches so that the patches P1 to Pn are developed with developing biases V1 to Vn, respectively. Densities D1 to Dn of the patches P1 to Pn formed on the photosensitive drum are respectively measured by a density sensor.

In the case where the latent images of the patches for density detection are developed by the different developing biases (VDC), the relation (V-D characteristic) between the developing bias (VDC) and the density (O. D.) of the patch becomes as shown in FIG. 4. As is apparent from FIG. 4, the V-D characteristic is composed of parts A and C where the change of the characteristic is small, and a part B where the characteristic is largely changed. This V-D characteristic varies also in accordance with an environment where the image forming apparatus is installed. For example, such a characteristic as shown in FIG. 5 is obtained. In FIG. 5, a characteristic a is the same as that of FIG. 4, a characteristic b is one under a high temperature, high humidity environment, and a characteristic c is one under a low temperature low humidity environment.

As shown in FIG. 4, in the V-D characteristic, the change of the density is unstable in the parts A and C, and the density is stably increased in the part B. Thus, as shown in FIG. 5, with respect to image density control, a control target density DTarget is set in the part B, and the developing biases V1 to Vn are set such that the densities D1 to Dn of the respective patches become D1<D2< . . . <Di<Di+1< . . . <Dn, and the control target density DTarget falls into almost the middle portion of the densities D1 to Dn. The values of the developing biases V1 to Vn are set such that even if the V-D characteristic is slightly changed and the values of the densities D1 to Dn are changed, the control target density DTarget falls within the range of the densities D1 to Dn, and an interval w between the developing bias V1 and the developing bias Vi+1 shown in the drawing is set at about 50 V.

As described above, since the V-D characteristic varies greatly in accordance with the environment, when the values of the developing biases V1 to Vn are fixed, like the characteristic b and the characteristic c shown in FIG. 5, the control target density DTarget deviates from the range of the densities D1 to Dn. Then, the developing biases V1 to Vn are also changed according to each environment so that the control target density DTarget falls almost into the middle portion of the densities D1 to Dn. For example, as shown in FIG. 6, under a high temperature high humidity environment, the developing biases V1 to V4 are used to carry out the image density control.

When the image density control is started, among the developing biases V1 to Vn, ones suitable for the image density control at that time are selected in accordance with an absolute amount of moisture in the apparatus calculated from a temperature and moisture sensor provided in the image forming apparatus. By using the data of the densities D1 to Dn of the respective patches measured by the density sensor and the developing biases V1 to Vn at the formation of the respective patches, a developing bias VTarget optimum for obtaining the control target density DTarget is calculated in the image density control circuit.

A method of calculating the optimum developing bias is such that, among the densities D1 to Dn, an interval in which the control target density DTarget is contained, that is, an interval (i to i+1) where Di≦DTarget≦Di+1 is established is searched. In the case where such an interval is found, the developing bias VTarget for obtaining the DTarget is calculated using linear interpolation on the basis of the equation 1.

$$VTarget=\{(Vi+1-Vi)/(Di+1-Di)\}\times(DTarget-Di)+Vi \quad \text{(Equation 1)}$$

The optimum developing bias VTarget is calculated with the above equation.

This developing bias VTarget is held in a memory, and image formation is carried out by using this value until the next image density control is carried out.

However, in such an image forming apparatus, the V-D characteristic varies not only in accordance with an environment where the apparatus is installed, but also in accordance with a driving state of the apparatus. For example, like a characteristic c shown in FIG. 7, an amount of electric charge of a developer is temporarily lowered after a long dormant (sleep) state, so that the V-D characteristic is shifted to a low density side.

As a result, there is a fear that the control target density DTarget will deviate from the range of the densities D1 to Dn and an error will occur. If the V-D characteristic is further shifted through addition of conditions such as deterioration in durability of the developer, the possibility that an error will occur is further increased.

In the case where an error occurs, a process to select a default developing bias previously set as a value of the developing bias VTarget must be carried out. For example, the default developing bias is such a value as an intermediate value between V1 and Vn, V1 if DTarget<D1, or Vn if Dn<DTarget.

In this case, only a minimum image is assured, and an image having a stable density can not be obtained. In order to suppress such a state to the utmost, a method is conceivable that the interval w between the respective developing biases V1 to Vn is widened or the number of patches is increased to widen the range of the developing biases which can be controlled. However, there are problems that an error in linear interpolation may become large in the method of widening the interval between the developing biases, or the amount of consumed developer may become large in the method of increasing the number of patches.

A decrease in the amount of electric charge of a developer after a dormant period and a shift in the V-D curves are temporary, and when the image formation processing is restarted, they are quickly returned to a steady state. Thus, as the amount of electric charge is recovered, the VTarget determined on the basis of the temporary shift of the V-D curves in the image density control immediately after the sleep becomes an unsuitable value, so that it becomes impossible to obtain an image having a stable density. In order to suppress a state to the utmost, such a method is conceivable that an execution interval of image density control is set to be short so that a suitable VTarget following the recovering process of the amount of the electric charge is obtained. However, such a method causes the image density control to be frequently carried out, with the result that developer consumption becomes large, which is a problem.

SUMMARY OF THE INVENTION

An object of the present invention is to provide a unit detachably attachable to a main body of an image forming apparatus which can obtain an image having a stable developer density, and an image forming apparatus.

Another object of the present invention is to provide a developing apparatus and an image forming apparatus which can quickly cope with changes of development processing conditions and image formation processing conditions due to a developer after a dormant (sleep) state in which an amount of electric charge has become small, so that an image having a stable developer density can be obtained without wastefully consuming the developer.

Still another object of the present invention is to provide a unit detachably attachable to a main body of an image forming apparatus, which comprises developing means for developing a latent image born on an image bearing body, and storage means for storing a time which has elapsed from a last developing operation of the developing means.

Still another object of the present invention is to provide an image forming apparatus which comprises an image bearing body for bearing a latent image, developing means for developing the latent image born on the image bearing body, and storage means for storing a time which has elapsed from a last developing operation of the developing means.

Objects of the present invention other than the above and features of the present invention will become more apparent by reading the following detailed description while referring to the accompanying drawings.

DESCRIPTION OF THE PREFERRED EMBODIMENTS

Preferred embodiments of the present invention will be described below with reference to the attached drawings.

First Embodiment

Figure 1:
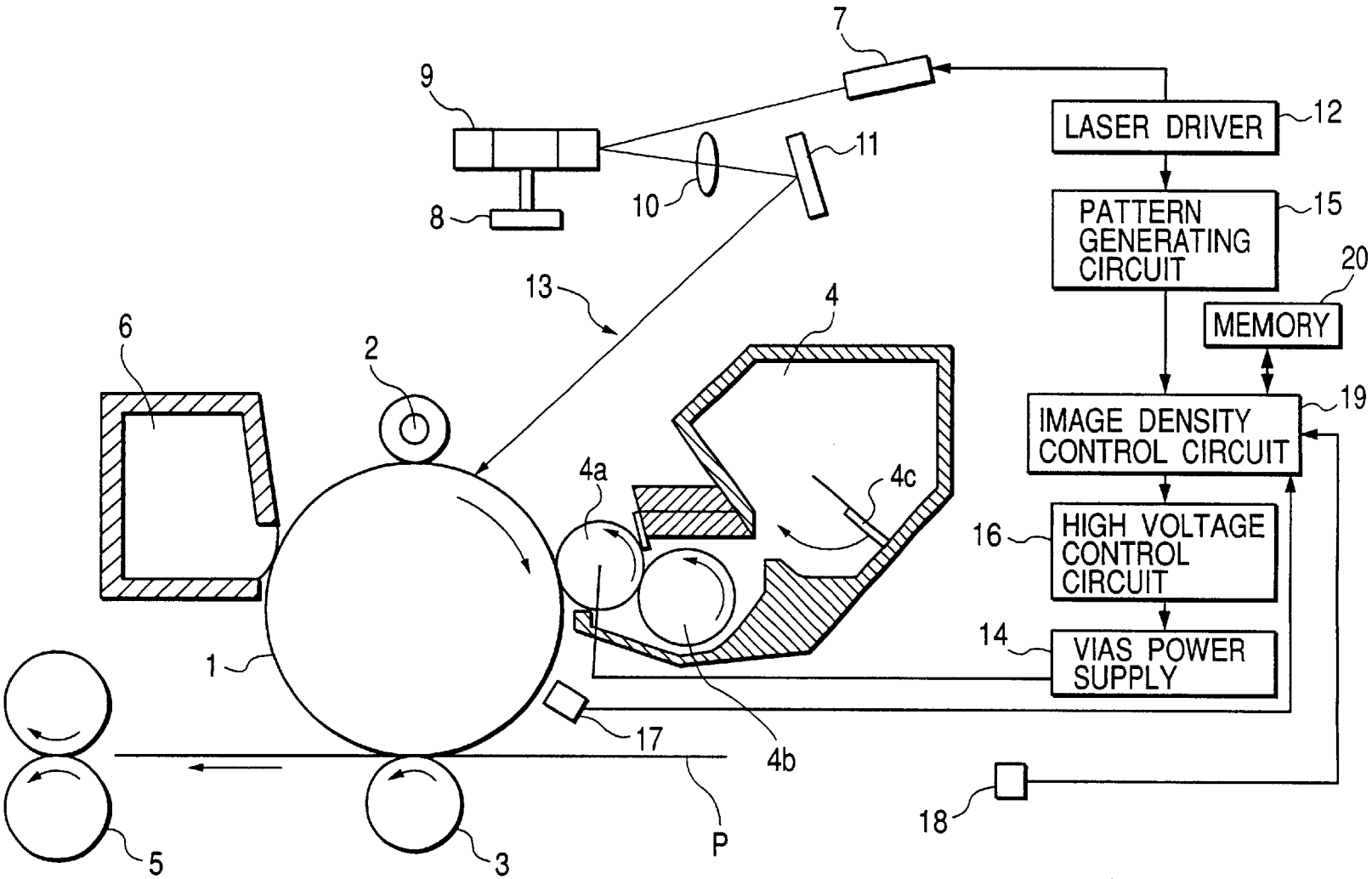
FIG. 1 is a schematic sectional view showing a structure of an image forming apparatus according to a first embodiment of the present invention.

FIG. 1 is a schematic sectional view showing a structure of an image forming apparatus according to a first embodiment of the present invention.

As shown in FIG. 1, the image forming apparatus comprises a drum-shaped photosensitive drum 1 as a latent image bearing body, on an outer peripheral surface of which an electrostatic latent image is formed, a roller charging device 2 for charging the outer peripheral surface of the photosensitive drum 1 to a specified potential, an exposure device for forming the electrostatic latent image by exposing the outer peripheral surface charged to the specified potential, a developing device 4 for transforming the electrostatic latent image into a visible image using a toner as a developer, a roller-shaped transfer roller 3 for transferring the visible image (visualized image) formed on the outer peripheral surface onto a sheet of transfer paper P as a sheet-like recording material, and a fixing device 5.

In FIG. 1, the photosensitive drum 1 is formed by applying a photoconductor of an organic photosensitive material (OPC) or A-Si, CdS, Se, etc. onto an outer peripheral surface of an aluminum cylinder. The photosensitive drum is rotated by driving means (not shown) in a direction of the arrow in the drawing, and is uniformly charged to a predetermined potential by the roller charging device 2.

The exposure device is disposed at an upper portion in a main body of the image forming apparatus, and includes a laser diode 7, a polygon mirror 9 rotated by a high speed motor 8, a lens 10, and a turning mirror 11.

When an image signal is input to a laser driver 12, the laser driver 12 causes the laser diode 7 to emit a light. The light from the laser diode 7 passes through a light path 13, and the photosensitive drum 1 is irradiated with light having optical information corresponding to the image signal, so that a latent image is formed on the photosensitive drum 1.

Further, when the photosensitive drum 1 advances in the arrow direction, a developing bias of a DC voltage superimposed with an AC voltage, having a frequency of 800 to 3500 Hz, an amplitude of 400 to 3000 V, and an integrating mean value VDC of waveform of −50 to −550 V is applied from a bias power supply 14 between the photosensitive drum 1 and a developing sleeve 4*a* as a developer bearing body for bearing a developer, so that the latent image is developed and becomes a toner image as a visible image. The toner image developed in this way is transferred onto the transfer paper P as a recording material by the transfer roller 3 to which a predetermined bias has been applied. The transfer paper P on which the toner image has been transferred is conveyed by conveying means (not shown), and the toner image is melted and fixed onto the transfer paper P by the fixing device 5 and becomes a permanent image.

Incidentally, toner remaining on the photosensitive drum 1 is cleaned by a cleaning device 6 constituted by, for example, a fur brush, blade means, etc.

Subsequently, an image density control in the image forming apparatus of this embodiment will be described.

During image density control, first, when the image density control is started, an image density control circuit 19, as adjusting means provided in the image forming apparatus, causes a pattern generating circuit 15 to generate an image signal expressing a patch as a toner image for density detection, and based on this signal, latent images for n patches P1 to Pn are formed along a rotational direction on the photosensitive drum 1. Next, the latent images are developed by the developing device 4, and at this time, a developing bias (VDC) is changed for the respective patches by a high voltage control circuit 16, and the patches P1 to Pn are developed by the developing biases V1 to Vn, respectively. Densities D1 to Dn of the respective patches P1 to Pn formed on the photosensitive drum 1 are measured by a density sensor 17 as detecting means.

Figure 4:
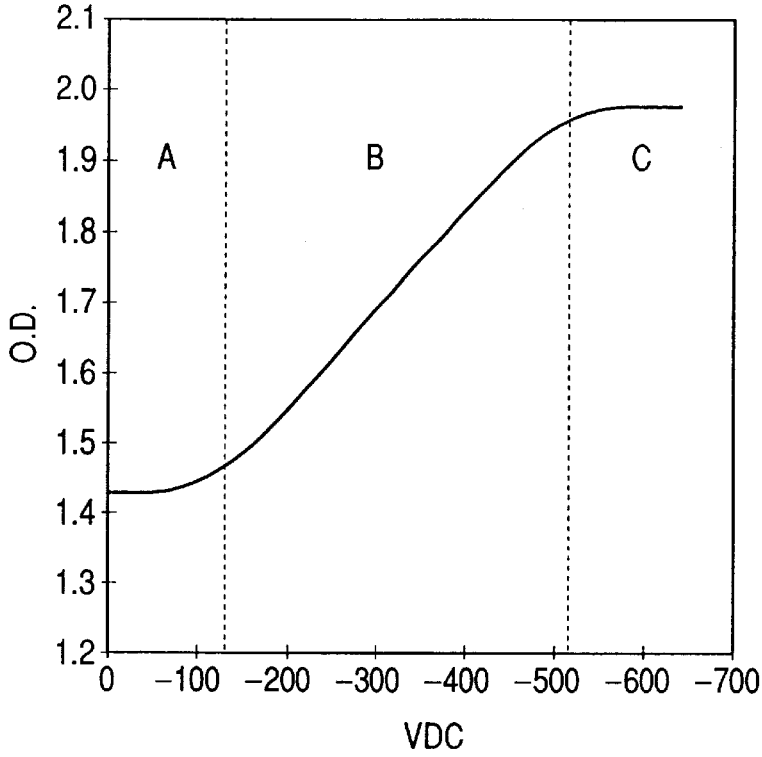
FIG. 4 is a graph showing a V-D characteristic of a relation between a developing bias and a patch density.
Figure 5:
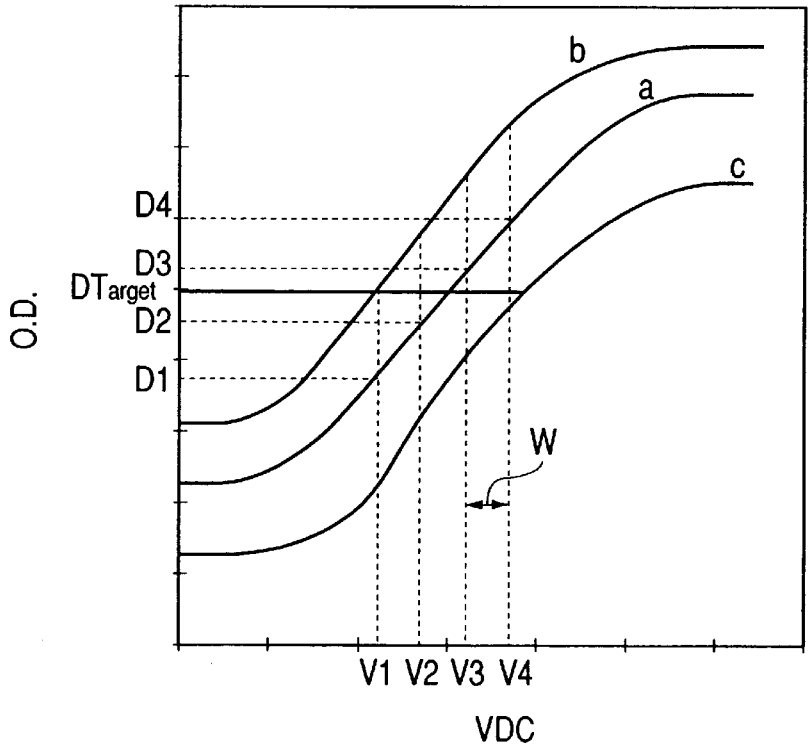
FIG. 5 is a graph showing a V-D characteristic under respective environments and a relation between a developing bias and an image density for explaining a method of determining a developing bias used for an image density control.

In the case where the latent images of the patches for density detection are developed by the different developing biases (VDC), the relation (V-D characteristic) between the developing bias (VDC) and the density of the patch (O.D.) becomes as shown in FIG. 4. As is apparent from FIG. 4, the V-D characteristic is composed of the parts A and C where the change of the characteristic is small, and the part B where the characteristic is largely changed. This V-D characteristic also varies in accordance with an environment where the image forming apparatus is installed, and for example, it becomes a characteristic as shown in FIG. 5. In FIG. 5, the characteristic a is the same as that of FIG. 4, the characteristic b is one under a high temperature high humidity environment, and the characteristic c is one under a low temperature, low humidity environment.

As shown in FIG. 4, in the V-D characteristic, the change of the density in the parts A and C is unstable, and the density in the part B is stably increased. Thus, as shown in FIG. 5, during image density control, a control target density DTarget is set in the part B, and the developing biases V1 to Vn are set such that the densities D1 to Dn of the respective patches become D1<D2< . . . <Di<Di+1< . . . <Dn, and the control target density DTarget falls into almost the middle portion of the densities D1 to Dn. The values of the developing biases V1 to Vn are set such that even if the V-D characteristic is slightly changed and the values of the densities D1 to Dn are changed, the control target density DTarget falls within the range of the densities D1 to Dn, and the interval w between the developing bias Vi and the developing bias Vi+1 shown in the drawing is set at about 50 V.

Figure 6:
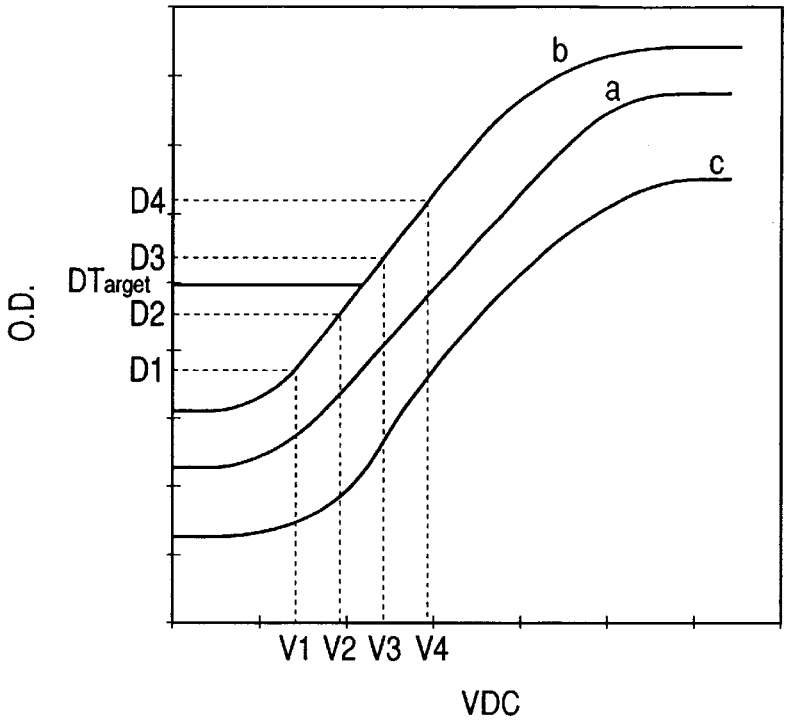
FIG. 6 is a graph showing a relation between a developing bias and an image density for explaining a method of determining a developing bias used for an image density control under a high temperature high humidity environment.
Figure 7:
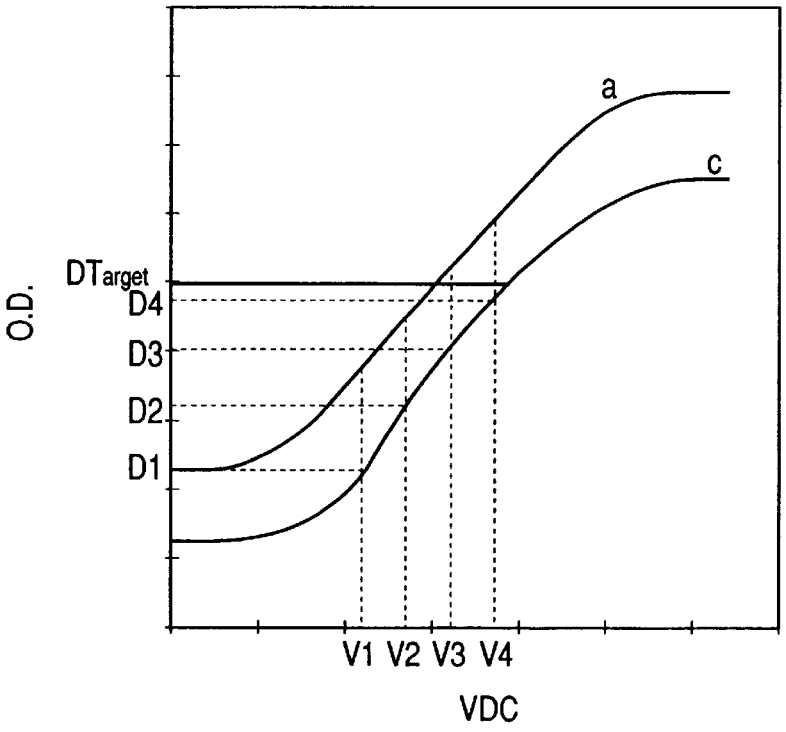
FIG. 7 is a graph showing a relation between a V-D characteristic immediately after a dormant period and a normal V-D characteristic.

As described above, since the V-D characteristic varies largely in accordance with the environment, when the values of the developing biases V1 to Vn are fixed, like the characteristic b and the characteristic c shown in FIG. 5, the control target density DTarget deviates from the range of the densities D1 to Dn. Then, the developing biases V1 to Vn are also changed according to each environment so that the control target density DTarget falls almost into the middle portion of the densities D1 to Dn. For example, as shown in FIG. 6, under a high temperature, high humidity environment, the developing biases V1 to V4 are used to carry out image density control.

When the image density control is started, among the developing biases V1 to Vn, ones suitable for image density control at that time are selected in accordance with an absolute amount of moisture in the apparatus calculated from a temperature and moisture sensor 18 provided in the image forming apparatus. By using the data of the densities D1 to Dn of the respective patches measured by the density sensor 17 and the developing biases V1 to Vn at the formation of the respective patches, a developing bias VTarget optimum for obtaining the control target density DTarget is calculated in the image density control circuit 19.

A method of calculating the optimum developing bias is such that, first, among the densities D1 to Dn, an interval in which the control target density DTarget is contained, that is, an interval (i to i+1) where Di≦DTarget≦Di+1 is established is searched. In the case where such an interval is found, the developing bias VTarget for obtaining the DTarget is calculated using linear interpolation on the basis of Equation 1.

$$VTarget=\{(Vi+1-Vi)/(Di+1-Di)\}\times(DTarget-Di)+Vi \quad \text{(Equation 1)}$$

The optimum developing bias VTarget is calculated with the above equation.

In the image forming apparatus according to this embodiment, a memory 20 as storage means provided in the main body of the image forming apparatus holds this developing bias VTarget, and image formation is carried out using this value until the next image density control is carried out.

In the image forming apparatus according to this embodiment, first, four patches P1 to P4 corresponding to four different developing biases V1 to V4 are formed on the photosensitive drum 1, and after the densities D1 to D4 corresponding to these patches are obtained, an interval where the control target density DTarget is contained is searched among these D1 to D4. In the case where such an interval is found, the developing bias VTarget is calculated by interpolating in the linear interpolation expressed by the foregoing Equation 1. Thus, in order to carry out suitable image density control, it is necessary that the control target density DTarget is contained among the patch densities D1 to D4.

Then the image forming apparatus according to this embodiment includes sleep time count means (not shown) as measuring means for measuring an elapsed time (sleep time) from the end of a previous image formation processing (development processing), and the memory 20 as storage means for storing the elapsed time measured by the sleep time count means, and the apparatus is set such that after the developing sleeve 4*a* and a developer supply roller 4*b* are driven for a predetermined time in accordance with the measured elapsed time from the end of the previous image formation processing to receipt of an image formation processing instruction, the image formation processing is started.

That is, in this embodiment, in the case where the sleep time stored in the memory 20 is greater than or equal to a fixed value, when the image density control circuit 19 again starts an the image formation processing, the developing sleeve 4*a* and the developer supply roller 4*b* for supplying a developer to the developing sleeve 4*a* are driven for a predetermined time determined on the basis of the sleep time, and then, the image formation processing is started. Thus, it is designed such that the image formation processing is carried out after an amount of electric charge of a toner which was lowered during the dormant (sleep) is recovered. For example, when the dormant (sleep) time is Ts (hr) and the drive time of the developing device is Td (sec), driving is made in the relation of $Td=\alpha Ts$ (where, $Td \leqq Tdmax$). The maximum value of the drive time Td of the developing device is the time Tdmax in which a sufficient amount of toner electric charge can be obtained for a toner in a new developing unit to which any electric charge is not given, and the count of the sleep time Ts is made to stop at $Tsmax=Tdmax/\alpha$. Also, a table indicating the relation between the sleep time Ts and the drive time Td of the developing device may be provided in advance. Incidentally, either one of the developing sleeve 4*a* or the developer supply roller 4*b* may be driven for the predetermined time. By this, it is possible to prevent the control target density DTarget from deviating from the range of the patch densities D1 to D4 as the amount of electric charge of the toner is lowered, and an image having a stable density can be obtained.

Incidentally, the memory 20 provided in the main body of the image forming apparatus includes a region where a value of a variable T corresponding to the elapsed time (sleep time) from the end of the last image formation processing (developing processing) is written. At the time of the start of the image formation processing, zero is written as the value of T in the memory 20, and after the end of the image formation processing, the value of T is incremented by 1 for every 5 minutes and is written in the memory. The value of 5 minutes with respect to the accuracy of measurement of the sleep time is set as a value at which sufficient accuracy can be obtained for determining a time in which a recovering processing of an amount of toner electric charge is carried out, and a suitable value can be set according to necessity.

Thus, according to this embodiment, the sleep time count means measures the elapsed time from the end of the previous image formation processing, and in accordance with the measured elapsed time from the previous image formation processing to the receipt of the image formation processing instruction, the developing sleeve 4*a* and the developer supply roller 4*b* are driven for a predetermined time, and then, the image formation processing is started. Thus, the developing sleeve 4*a* and the developer supply roller 4*b* charge the toner, the amount of electric charge of which was reduced since the toner was left as it was from the end of the previous image formation processing to the receipt of an image formation processing instruction, so that the toner is not wastefully consumed and an image having a stable toner density can be obtained.

Second Embodiment

Next, an image forming apparatus according to a second embodiment of the present invention will be described. Incidentally, with respect to the same structure as the first embodiment, its description is omitted.

In this embodiment, in the case where a count value by sleep time count means becomes some constant value or more, when the image density control circuit 19 again starts an image formation processing, image density control is carried out with an execution interval between the first image density control carried out immediately after cancellation of sleep time and the next second image density control being set shorter than a normal interval, so that a suitable VTarget can be obtained according to recovery of an amount of electric charge of a toner. Also, an execution interval of the image density control which is carried out subsequent to the second image density control, not immediately after the cancellation of the sleep mode, and in the case where image formation for a predetermined number of paper sheets is carried out, is the same in the number of paper sheets as a normal case, so that an image having a stable density can be obtained while preventing wasteful consumption of toner.

Thus, according to this embodiment, the sleep time count means measures an elapsed time from the end of the previous image formation processing, and in accordance with the measured elapsed time from the end of the previous image formation processing to the start of image formation processing, the image density control circuit 19 shortens an adjusting time interval of the toner density from the start of the image formation processing to several times of adjustments. Thus, it is possible to quickly cope with a change of image formation processing conditions due to the toner, the amount of electric charge of which was reduced since the toner was left as it was from the end of the previous image formation processing to the receipt of an image formation processing instruction, so that the toner is not wastefully consumed and an image having a stable toner density can be obtained.

Third Embodiment

Next, an image forming apparatus according to a third embodiment of the present invention will be described. Incidentally, with respect to the same structure as the first embodiment, its description is omitted.

Figure 2:
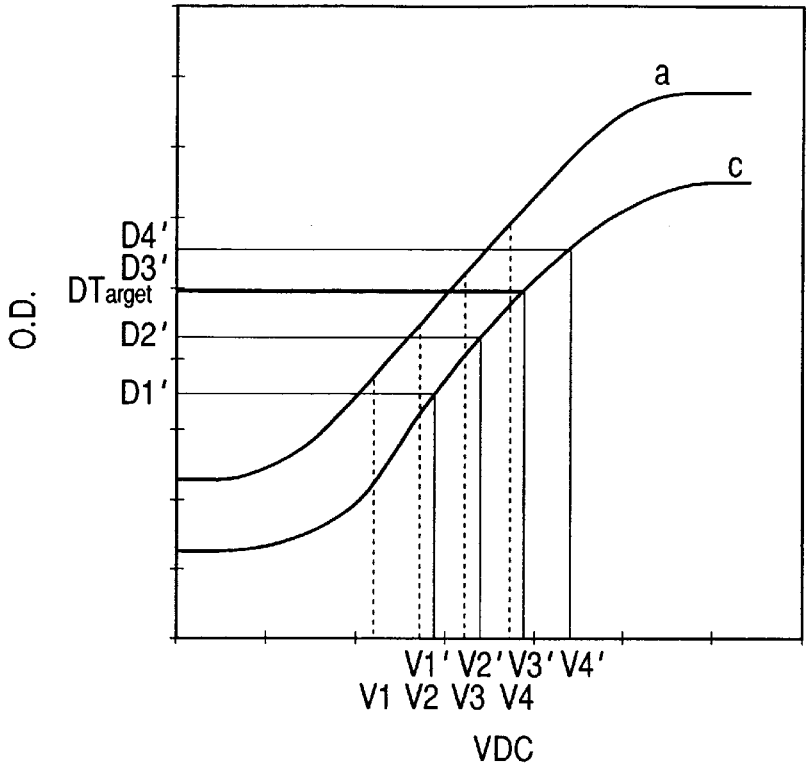
FIG. 2 is a graph showing a relation between a developing bias and an image density for explaining an image density control method according to a third embodiment of the present invention.

In this embodiment, in the case where a count value by the sleep time count means becomes some constant value or more, at the time of execution of first image density control after the image formation processing is again started, normal patch formation developing biases V1 to V4 are not used, but as shown in FIG. 2, a bias at which image forming means (not shown) starts to form a patch is changed from V1 to V1' according to the change of the V-D characteristic due to a sleep state, and V2 to V4 are similarly changed, so that the patches are formed by using the biases of V1' to V4'. Thus, it is possible to prevent an error where the DTarget deviates from the range of patch densities D1' to D4'. By changing the start bias of a patch, it is possible to take measures without increasing the number of patches and without increasing the interval w of the patches very much, so that an increase in an error in the interpolation calculation with the foregoing Equation 1 can be suppressed, and an image having a stable density can be obtained while preventing the wasteful consumption of toner. Incidentally, the characteristic a and the characteristic c shown in FIG. 2 are the same as that shown in FIG. 5.

Thus, according to this embodiment, the sleep time count means measures an elapsed time from the end of a previous image formation processing, and in accordance with the measured elapsed time from the end of the previous image formation processing to the start of image formation processing, image forming means forms a toner image on the photosensitive drum 1 while the image formation processing condition from the start of the image formation processing to the first adjustment is changed. Thus, it is possible to quickly cope with the change in image formation processing conditions due to the toner, the amount of electric charge of which was reduced since the toner was left as it was from the end of the previous image formation processing to the receipt of an image formation processing instruction, so that the toner is not wastefully consumed and an image having a stable toner density can be obtained.

Fourth Embodiment

Next, an image forming apparatus according to a fourth embodiment of the present invention will be described. Incidentally, with respect to the same structure as the first embodiment, its description is omitted.

Figure 3:
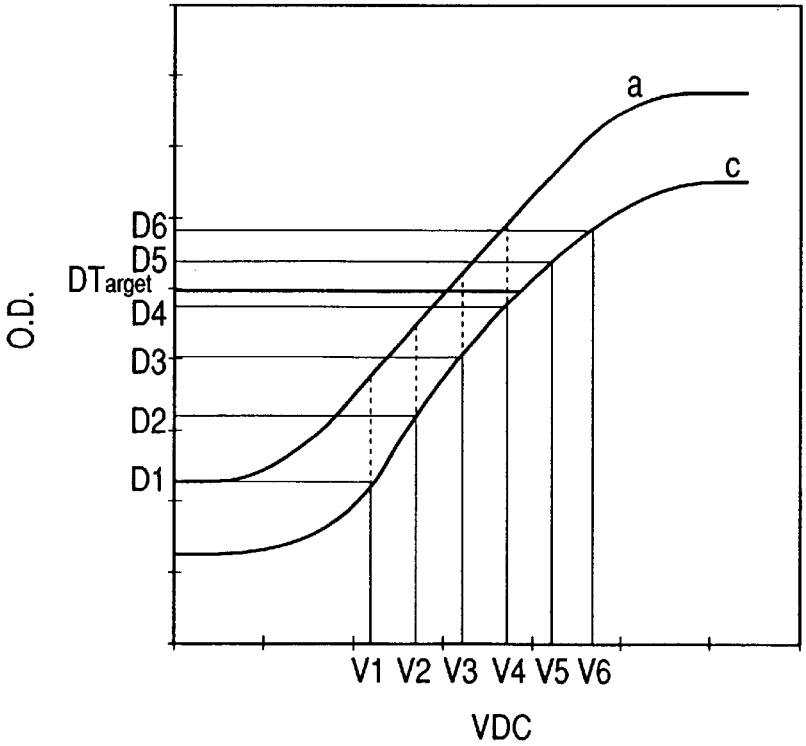
FIG. 3 is a graph showing a relation between a developing bias and an image density for explaining an image density control method according to a fourth embodiment of the present invention.

According to this embodiment, in the case where a count value by the sleep time count means becomes greater than or equal to a fixed value, at the time of execution of the first image density control after an image formation processing is again started, as shown in FIG. 3, image forming means (not shown) forms patches P1 to P6 using six developing biases V1 to V6, which are more than the normal four biases by two. Although an interval w between the developing biases for forming the respective patches is the same, the number of patches is increased, so that a wider range can be covered, and it is possible to prevent such an error that the DTarget deviates from the range of patch densities D1 to D6. Since the interval w of the patches is not changed, an error in the interpolation calculation with the foregoing Equation 1 is not increased. Further, the number of patches is merely increased at only the first image density control immediately after cancellation of the sleep state, so that toner consumption is not remarkably increased and an image having a stable density can be obtained. Incidentally, the characteristic a and the characteristic c shown in FIG. 3 are the same as that shown in FIG. 5.

Thus, according to this embodiment, the sleep time count means measures an elapsed time from the end of a previous image formation processing, and in accordance with the measured elapsed time from the end of the previous image formation processing to the start of the image formation processing, the image forming means forms toner images on the photosensitive drum 1 with many image formation processing conditions from the start of the image formation processing to the first adjustment. Thus, it is possible to quickly cope with a change of image formation processing conditions due to the toner, the amount of electric charge of which was reduced since the toner was left as it was from the end of the previous image formation processing to the receipt of an image formation processing instruction, so that the toner is not wastefully consumed and an image having a stable toner density can be obtained.

Fifth Embodiment

Next, an image forming apparatus according to a fifth embodiment of the present invention will be described. Incidentally, with respect to the same structure as the first embodiment, its description is omitted.

In this embodiment, similarly to the first embodiment, in the case where a sleep time stored in the memory 20 is some constant value or more, after the developing sleeve 4*a* and the developer supply roller 4*b* are driven for a predetermined time determined on the basis of the sleep time described above, the image formation processing is started, so that an amount of electric charge of a toner reduced during the sleep time (dormant state) is recovered.

Figure 8:
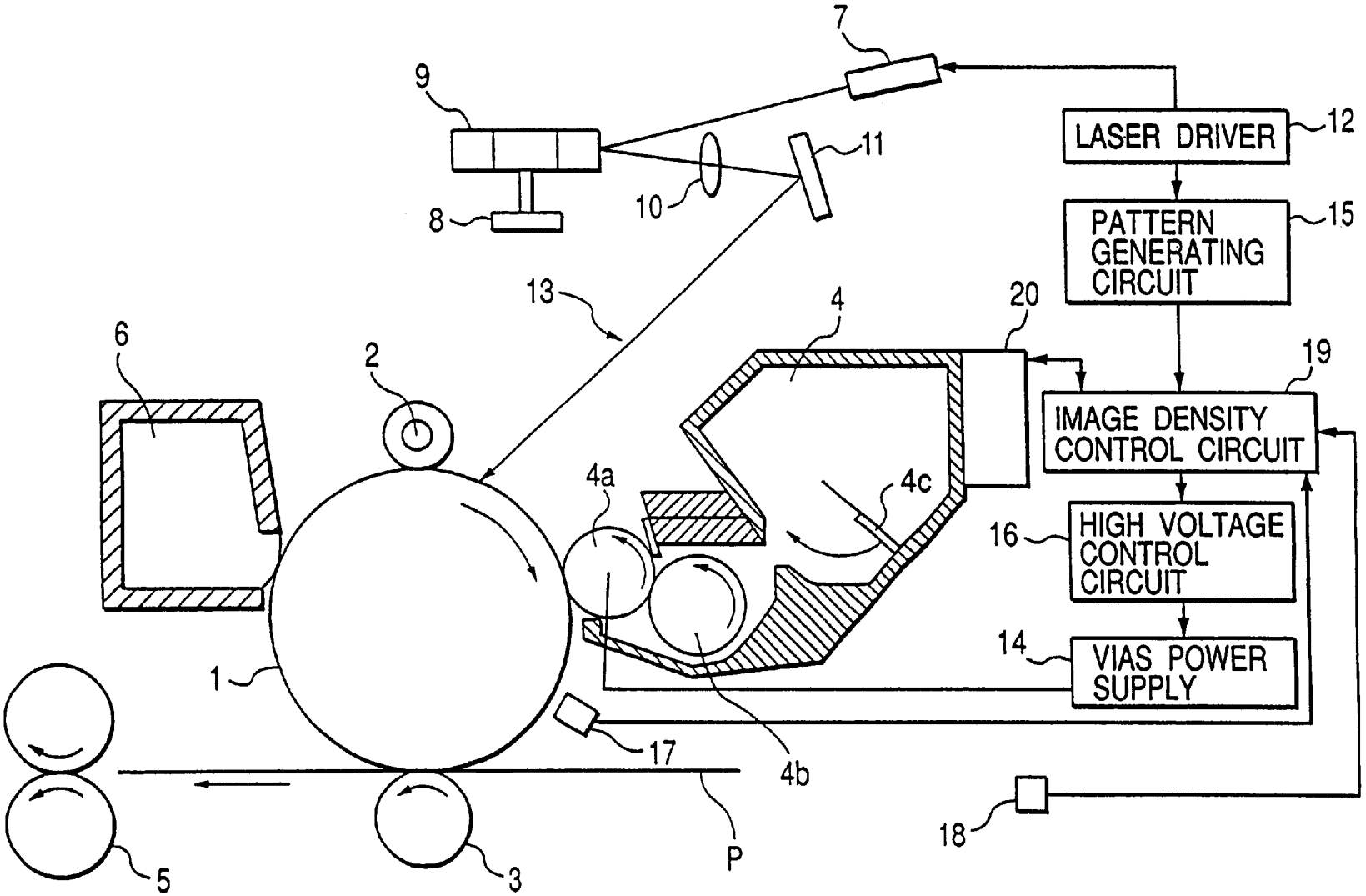
FIG. 8 is a schematic sectional view showing a structure of an image forming apparatus according to a fifth embodiment of the present invention.

In the first embodiment, a structure is adopted such that the memory 20 for storing the elapsed time is provided in the main body of the image forming apparatus as shown in FIG. 1. However, in this embodiment, as shown in FIG. 8, the memory 20 is provided to a developing unit detachably attachable to the main body of the image forming apparatus.

In the first embodiment, since information concerning an amount of electric charge of a toner in each developing unit can not be obtained from the memory provided to the main body of the image forming apparatus, even in the case where, for example, a user repeats an exchange of a developing unit and a developing device having a sufficient amount of electric charge of a toner is mounted to the main body of the image forming apparatus, it is impossible to omit an unnecessary process of giving an electric charge to the toner by carrying out such processing as to drive the developing sleeve 4*a* for a predetermined time similarly to the case where a new developing device is mounted.

In this embodiment, a structure is adopted such that the memory is provided at the side of the unit detachably attachable to the main body of the image forming apparatus. Thus, even in the case where a user repeats an exchange of a developing unit, it is possible to correctly read a time elapsed from a last image formation processing carried out by each developing unit and to carry out the toner charging process only for a necessary and sufficient time. Incidentally, in a memory provided to a new developing unit, Tsmax set forth in the first embodiment is stored as an elapsed time from the last image formation processing.

Thus, according to this embodiment, the sleep time count means measures an elapsed time from the end of a previous image formation processing, and in accordance with the elapsed time to the receipt of the next image formation processing instruction, the developing sleeve 4*a* and the developer supply roller 4*b* are driven for a predetermined time, and then, the image formation processing is started. Thus, the developing sleeve 4*a* and the developer supply roller 4*b* charge the toner the amount of electric charge of which was reduced since the toner was left as it was from the end of the previous image formation processing to the receipt of a next image formation processing instruction. Further, the memory for storing the elapsed time is not provided at the main body of the image forming apparatus, but is provided at the unit detachably attachable to the main body, so that it is possible to correctly cope with a unit exchange and the like, and an image having a stable toner density can be obtained without wastefully consuming the toner.

Sixth Embodiment

Next, an image forming apparatus according to a sixth embodiment of the present invention will be described. Incidentally, with respect to the same structure as the first embodiment to the fifth embodiment, its description is omitted.

In this embodiment, similarly to the second embodiment, in the case where a sleep time stored in the memory is some constant value or more, an execution interval between the first image density control carried out immediately after cancellation of a sleep state and the next second image density control is set shorter than a normal interval, and the image density control is carried out, so that a suitable VTarget can be obtained according to recovery of an amount of electric charge of a toner. An execution interval of image density control which is carried out subsequent to the second image density control, not immediately after the cancel of the sleep mode, and in the case where image formation for a predetermined number of paper sheets is carried out, is the same in the number of paper sheets as a normal case, so that an image having a stable density can be obtained while preventing wasteful consumption of the toner.

However, since the memory for storing the sleep time is not provided at the main body of the image forming apparatus, but is provided at the unit detachably attachable to the main body of the image forming apparatus, it is possible to correctly cope with a unit exchange and the like, and an image having a stable toner density can be obtained without wastefully consuming the toner.

Seventh Embodiment

Next, an image forming apparatus according to a seventh embodiment of the present invention will be described. Incidentally, with respect to the same structure as the first embodiment to sixth embodiment, its description is omitted.

In this embodiment, similarly to the third embodiment, when an image formation processing is started again after a sleep state, in the case where a sleep time stored in the memory is some constant value or more, at the time of execution of the first image density control after restarting of the image formation processing, the normal patch formation developing biases V1 to V4 are not used, but as shown in FIG. 2, a bias at which formation of a patch starts is changed from V1 to V1' according to the change of the V-D characteristic due to the sleep state, and V2 to V4 are also similarly changed, so that the patches are formed by using the biases V1' to V4'. Thus, it is possible to prevent such an error that the DTarget deviates from the range of patch densities D1' to D4'. By changing the start bias for formation of a patch, it is possible to cope with lowering of an amount of electric charge of a toner without increasing the number of the patches and without increasing the interval w of the patches very much. Thus, it is possible to suppress an increase of an error in the interpolation calculation with the foregoing Equation 1, and an image having a stable density can be obtained while preventing wasteful consumption of the toner.

However, since the memory for storing the sleep time is not provided at the main body of the image forming apparatus, but is provided at the unit detachably attachable to the main body of the image forming apparatus, it is possible to correctly cope with a unit exchange and the like, and an image having a stable toner density can be obtained without wastefully consuming the toner.

Eighth Embodiment

Next, an image forming apparatus according to an eighth embodiment of the present invention will be described. Incidentally, with respect to the same structure as the first embodiment to the seventh embodiment, its description is omitted.

In this embodiment, similarly to the fourth embodiment, when an image formation processing is started again after a sleep state, in the case where a sleep time stored in the memory is some constant value or more, at the time of execution of the first image density control after restarting of the image formation processing, as shown in FIG. 3, patches P1 to P6 are formed using six developing biases V1 to V6 which are more than normal four biases by two. Although an interval w between the developing biases for forming the respective patches is the same, the number of patches is increased, so that a wider range can be covered, and it is possible to prevent such an error that the DTarget deviates from the range of the patch densities D1 to D6. Since the interval w of the patches is not changed, an error in the interpolation calculation with the foregoing Equation 1 is not increased. Further, the number of patches is merely increased at only the first image density control immediately after the cancellation of the sleep state, so that an image having a stable density can be obtained while toner consumption is hardly increased.

However, the memory for storing the sleep time is not provided at the main body of the image forming apparatus, but is provided at the unit detachably attachable to the main body of the image forming apparatus, so that it is possible to correctly cope with a unit exchange and the like, and an image having a stable toner density can be obtained without wastefully consuming the toner.

Incidentally, although the fifth to eighth embodiments show examples in which the developing unit includes the memory, such a structure may be adopted in which a process cartridge including an image bearing body and at least developing means includes the memory.

As described above, an image forming apparatus comprises:

an image bearing body for bearing a latent image;

developing means for developing the latent image born on the image bearing body; and storage means for storing a time which has elapsed from a last developing operation of the developing means.

Besides, the image forming apparatus further comprises:

image density control means for detecting a density of a developer image for density detection and for controlling an image density on the basis of the detected density;

wherein when the developing means starts a developing operation, in the case where the time stored in the storage means is a predetermined time or more, an image density control is carried out by the image density control means.

The image density control means sets a developing bias for obtaining a desired image density as the image density control.

The developing means includes a developer bearing body for bearing a developer, and before the developing operation is started, the developer bearing body is driven for a predetermined time.

A time in which the developer bearing body is rotated is determined in accordance with the time stored in the storage means.

A time in which the developer bearing body is rotated is determined to be proportional to the time stored in the storage means.

The developing means includes a developer supply member for supplying the developer to the developer bearing body, and before the developing operation is started, the developer supply member is also driven.

In an execution interval between the first image density control carried out by the image density control means in the case where the time stored in the storage means is a predetermined time or more and an image density control subsequently carried out by the image density control means is shorter than a normal execution interval.

In the first image density control carried out by the image density control means in the case where the time stored in the storage means is a predetermined time or more, the image density control means detects a density of a developer image for density detection which has been formed by using a developing bias different from a normal developing bias, and controls an image density on the basis of the detected density.

The number of developer images for density detection used in the first image density control carried out by the image density control means in the case where the time stored in the storage means is a predetermined time or more, is larger than the number of normal developer images for density detection.

The developing means includes a developer bearing body for bearing a developer, and a developing bias of a DC voltage superposed with an AC voltage is applied between the developer bearing body and the image bearing body.

A unit detachably attachable to a main body of an image forming apparatus comprises:

developing means for developing a latent image born on an image bearing body; and storage means for storing a time which has elapsed from a last developing operation of the developing means.

The unit is a process cartridge including an image bearing body.

What is claimed is:

1. A unit detachably attachable to a main body of an image forming apparatus, comprising:

developing means, including a developer bearing body for bearing a developer, for developing a latent image born on an image bearing body, and for driving said developer bearing body for a predetermined time prior to starting a developing operation; and storage means for storing a time which has elapsed from a last developing operation of said developing means, wherein the predetermined time which said developing means drives said developer bearing body prior to starting a developing operation is proportional to the time stored in said storage means.

2. A unit according to claim 1, wherein the main body of said image forming apparatus includes image density control means for detecting a density of a developer image and for controlling an image density on the basis of the detected density, wherein, when said unit is mounted in the main body of the image forming apparatus, and the time stored in said storage means is equal to or greater than a predetermined time when said developing means starts a developing operation, the image density control means carries out an image density control operation.

3. A unit according to claim 2, wherein the image density control means sets a developing bias for obtaining a desired image density as the image density control operation.

4. A unit according to claim 2, wherein in a first image density control operation carried out by the image density control means in a case where the time stored in said storage means is greater than or equal to a predetermined time, the image density control means detects a density of a developer image which has been formed using a developing bias different from a normal developing bias, and controls an image density on the basis of the detected density.

5. A unit according to claim 2, wherein for a developing bias of a DC voltage superposed with an AC voltage is applied between said developer bearing body and the image bearing body.

6. A unit according to claim 1, wherein said developing means includes a developer supply member for supplying developer to said developer bearing body, and wherein said developer supply member is driven prior to starting a developing operation.

7. A unit according to claim 1, wherein said unit is a process cartridge including the image bearing body.

8. A unit detachably attachable to a main body of an image forming apparatus, where the main body includes image density control means for detecting a density of a developer image and for controlling an image density on the basis of the detected density, the unit comprising;

developing means for developing a latent image born on an image bearing body; and storage means for storing a time which has elapsed from a last developing operation of said developing means;

wherein, when the unit is mounted in the main body of the image forming apparatus, and a time stored in said storage means is greater than or equal to a predetermined time when said developing means starts a developing operation, the image density control means carries out an image density control operation, and wherein an execution interval between a first image density control operation carried out by the image density control means in a case where the time stored in said storage means is greater than or equal to a predetermined time and an image density control operation subsequently carried out by the image density control means is shorter than a normal execution interval.

9. A unit detachably attachable to a main body of an image forming apparatus, where the main body includes image density control means for detecting a density of a developer image and for controlling an image density on the basis of the detected density, the unit comprising;

developing means for developing a latent image born on an image bearing body; and storage means for storing a time which has elapsed from a last developing operation of said developing means;

wherein, when the unit is mounted in the main body of the image forming apparatus, and a time stored in said storage means is greater than or equal to a predetermined time when said developing means starts a developing operation, the image density control means carries out an image density control operation, and wherein a number of developer images for density detection used in a first image density control operation carried out by the image density control means in a case where the time stored in said storage means is greater than or equal to a predetermined time is larger than a number of normal developer images for density detection.

10. An image forming apparatus, comprising:

an image bearing body for bearing a latent image;

developing means, including a developer bearing body for bearing a developer, for developing a latent image born on said image bearing body, and for driving said developer bearing body for a predetermined time prior to starting a developing operation; and storage means for storing a time which has elapsed from a last developing operation of said developing means, wherein a time in which said developing means drives said developer bearing body prior to starting a developing operation is proportional to the time stored in said storage means.

11. An image forming apparatus according to claim 10, further comprising:

image density control means for detecting a density of a developer image and for controlling an image density on the basis of the detected density, wherein, when the time stored in said storage means is greater than or equal to a predetermined time when said developing means starts a developing operation, said image density control means carries out an image density control operation.

12. An image forming apparatus according to claim 11, wherein in a first image density control operation carried out by said image density control means in a case where the time stored in said storage means is greater than or equal to the predetermined time, said image density control means detects a density of a developer image which has been formed using a developing bias different from a normal developing bias, and controls an image density on the basis of the detected density.

13. An image forming apparatus according to claim 10, wherein said image density control means sets a developing bias for obtaining a desired image density as the image density control operation.

14. An image forming apparatus according to claim 10, wherein said developing means includes a developer supply member for supplying developer to said developer bearing body, and said developing means drives said developer supply member prior to starting a developing operation.

15. An image forming apparatus according to claim 10, wherein a developing bias of a DC voltage superposed with an AC voltage is applied between said developer bearing body and said image bearing body.

16. An image forming apparatus comprising:

an image bearing body for bearing a latent image;

developing means for developing a latent image born on said image bearing body;

storage means for storing a time which has elapsed from a last developing operation of said developing means; and image density control means for detecting a density of a developer image and for controlling an image density on the basis of the detected density;

wherein, when the time stored in said storage means is greater than or equal to a predetermined time when said developing means starts a developing operation, said image density control means carries out an image density control operation, and wherein an execution interval between a first image density control operation carried out by said image density control means in a case where the time stored in said storage means is greater than or equal to the predetermined time and an image density control operation subsequently carried out by said image density control means is shorter than a normal execution interval.

17. An image forming apparatus comprising:

an image bearing body for bearing a latent image;

developing means for developing a latent image born on said image bearing body;

storage means for storing a time which has elapsed from a last developing operation of said developing means; and image density control means for detecting a density of a developer image and for controlling an image density on the basis of the detected density;

wherein, in the case where the time stored in said storage means is greater than or equal to the predetermined time when said developing means starts a developing operation, said image density control means carries out an image density control operation, and wherein a number of developer images for density detection used in a first image density control operation carried out by said image density control means in a case where the time stored in said storage means is greater than or equal to the predetermined is larger than a number of normal developer images for density detection.

* * * * *

UNITED STATES PATENT AND TRADEMARK OFFICE

CERTIFICATE OF CORRECTION

PATENT NO. : 6,226,467 B1
DATED : May 1, 2001
INVENTOR(S) : Tsuyoshi Nakagawa et al.

It is certified that error appears in the above-identified patent and that said Letters Patent is hereby corrected as shown below:

Column 3,
Line 19, "suppress" should read -- suppress such --; and "such" should be deleted.
Lines 50, and 44, "born" should read -- borne --.

Column 7,
Line 9, "is" should read -- time is --.

Column 12,
Line 22, "born" should read -- borne --.

Column 13,
Lines 13, and 23,"born" should read -- borne --.
Line 35, close up right margin.
Line 36, close up left margin.
Line 57, "for" should be deleted.

Column 14,
Lines 5, and 28, "comprising;"should read -- comprising: --.
Lines 6,29, and 50,"born" should read -- borne --.

Column 15,
Line 28, "born" should read -- borne --.

Column 16,
Line 15, "born" should read -- borne --.

Signed and Sealed this

Nineteenth Day of February, 2002

*Attest:*

*Attesting Officer*

JAMES E. ROGAN
*Director of the United States Patent and Trademark Office*